United States Patent [19]

Fabricius et al.

[11] Patent Number: 5,035,990

[45] Date of Patent: Jul. 30, 1991

[54] RADIOGRAPHIC ELEMENTS WITH IMPROVED COVERING POWER

[75] Inventors: Dietrich M. Fabricius; Otho P. Hoyte, both of Hendersonville, N.C.

[73] Assignee: E. I. Du Pont de Nemours and Company, Wilmington, Del.

[21] Appl. No.: 445,957

[22] Filed: Nov. 28, 1989

[51] Int. Cl.[5] ..... G03C 1/02

[52] U.S. Cl. ..... 430/567; 430/569; 430/611

[58] Field of Search ..... 430/567, 611, 569

[56] References Cited

U.S. PATENT DOCUMENTS

| | | | |
|---|---|---|---|
| 3,161,520 | 12/1964 | Raud et al. | 430/611 |
| 4,610,954 | 9/1986 | Torigoe et al. | 430/611 |
| 4,722,886 | 2/1988 | Nottozf | 430/567 |
| 4,797,354 | 1/1989 | Saitou et al. | 430/569 |
| 4,801,522 | 1/1989 | Ellis | 430/569 |

*Primary Examiner*—Charles L. Bowers, Jr.
*Assistant Examiner*—Thorl Chea

[57] ABSTRACT

An improved, tabular grain radiographic element is described. This element contains a covering power enhancing amount of a thione and exhibits improved covering power and contrast over elements made without the thione.

6 Claims, No Drawings

RADIOGRAPHIC ELEMENTS WITH IMPROVED COVERING POWER

FIELD OF THE INVENTION

This invention relates to photographic silver halide emulsions employing mainly tabular grains and to radiographic elements prepared therefrom. More specifically, this invention relates to radiographic elements with improved covering power and contrast.

BACKGROUND OF THE INVENTION

Emulsions which contain essentially tabular silver halide grains are well known in the prior art. These grains provide some advantages over more conventional, spherical grains. For example, silver halide X-ray elements containing tabular grains can be fully forehardened and yet maintain excellent covering power. This is an advantage over conventional X-ray elements containing spherical grains which are normally hardened during the processing steps. Additionally, tabular grains can be coated at a lower coating weight and thus have a silver savings over elements containing conventional grains. Also, elements containing tabular grains sometimes exhibit a higher speed than those with spherical grains. Sometimes, however, elements made using these tabular grains have lower covering power and lower gradient than those made with spherical grains, for example. Additionally, there are always needs to reduce silver halide coating weights still further in order to save on silver costs.

The use of various thiones within a silver halide element is also known. For example, heterocyclic thiones have been added in combination with other ingredients in order to increase the speed or reduce the color gradient within color emulsions, for example. None of these references disclose the addition of these compounds to tabular grain emulsions in order to increase the contrast and covering power thereof.

SUMMARY OF THE INVENTION

It is an object of this invention to provide tabular silver halide emulsions having increased covering power and contrast or gradient. It is yet another object of this invention to provide high contrast, high covering power tabular grain elements in which the coating weight can be reduced. It is yet another object of this invention to provide such tabular grain elements with good sensitometry and without deleterious side effects. These and yet other objects are achieved by providing a tabular grain emulsion wherein at least 50% of said grains are tabular silver halide grains with a thickness of at least 0.1 μm, preferably with a thickness of about 0.1 to 0.2 μm, and an aspect ratio of greater than 2:1, dispersed in a binder, and wherein said tabular grain emulsion is a negative working radiographic element the improvement comprising adding thereto a covering power enhancing amount of a thione with the following structure:

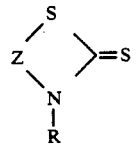

wherein Z represents sufficient carbon atoms to form a 5 membered or aromatic ring, or substituted 5 membered or aromatic ring, and R is an alkyl of 1–5 carbon atoms, a sulfoalkyl group of 2–5 carbon atoms, a dialkyl aminomethyl or a hydroxymethyl group.

DETAILED DESCRIPTION OF THE INVENTION

As employed herein the term "tabular" is defined as requiring that silver halide grains have a thickness of less than 0.5 micron (preferably less than 0.3 micron) and a diameter of at least 0.2 micron have an average aspect ratio of greater than 2:1 and account for a least 50 percent of the total projected area of the silver halide grains present in the emulsion.

The grain characteristics described above of the silver halide emulsions of this invention can be readily ascertained by procedures well known to those skilled in the art. As employed herein, the term "aspect ratio" refers to the ratio of the diameter of the grain to its thickness. From shadowed electron micrographs of emulsion samples, it is possible to determine the thickness of each grain and calculate an average therefrom. The average diameter of the grains is in turn determined from their area by assuming that said area is the ratio of the median volume (as measured independently by a conventional Electrolytic Grain Size Analyzer—EGSA) and from the thickness as determined from the aforesaid electron micrograph described above. Thus, we can identify those tabular gains having a thickness of less than 0.5 micron (or 0.3 micron) and calculate a diameter of at least 0.2 micron. From this, the aspect ratio of each such tabular grain can be calculated, and the aspect ratios of all the tabular grains in the sample meeting the thickness and diameter criteria, can be averaged to obtain their average aspect ratio. By this definition the average aspect ratio is the average of individual tabular grains aspect ratios. In practice it is usually simpler to obtain an average thickness and an average diameter of the tabular grains having a thickness of less than 0.5 (or 0.3) micron and a diameter of at least 0.2 micron and to calculate the average aspect ratio as the ratio of these two averages. Whether the averaged individual aspect ratios or the averages of thickness and diameter are used to determine the average aspect ratio, within the tolerance of grain measurements contemplated, the average aspect ratios obtained do not significantly differ. The projected areas of the silver halide grains meeting the thickness and diameter criteria can be summed, the projected areas of the remaining silver halide grains in the photomicrograph can be summed separately, and from the two sums the percentage of the total projected area of the silver halide grains provided by the grains meeting the thickness and diameter criteria can be calculated.

Various thiones can be used within the ambit of this invention to increase the covering power and contrast of the aforementioned tabular emulsions as used for radiographic purposes.

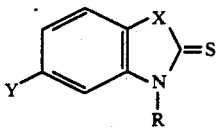

| Name | X | Y | R | MP (°C.) |
|---|---|---|---|---|
| 1 | S | H | $CH_3$ | 87.5–89 |
| 2 | S | H | $CH_2OH$ | 120–125 |
| 3 | S | H | $CH_2NEt_2$ | 169–172 |
| 4 | S | $OCH_3$ | $CH_3$ | 144 |
| 5 | S | H | $CH_2Q$ where Q = 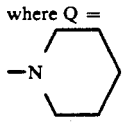 | 158 |
| 6 | 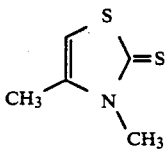 | | | 110–113 |
| 7 | 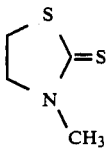 | | | 68 |

In the examples below the above numerical identification is employed. The thiones may be added to the emulsion in the range of 5 to 1000 mg of the compound per 1.5 moles of silver halide present therein. Preferably, we add these compounds in the range of 10 to 500 mg/1.5 moles of silver halide and more preferably 50 to 200 mg/1.5 moles of silver halide. Usually, we dissolve these compounds in a lower molecular weight alcohol such as methanol and then we add this solution to the emulsion preferably after the emulsion has been raised to its optimum sensitivity with gold and sulfur, for example. Additionally, these emulsions may be spectrally sensitized as is well-known in the prior art and in fact it is so preferred.

Any of the conventional halides may be used for the preparation of silver halide grains, but we prefer pure silver bromide or silver bromide with small amounts of iodide incorporated therein (e.g., 98% Br and 2% I by weight, for example).

Particularly preferred processes for preparing tabular silver halide elements useful within the metes and bounds of this invention are contained in Nottorf, U.S. Pat. No. 4,722,886, and in Ellis, U.S. Pat. No. 4,801,522 (both with the same assignee as the present patent application). These teachings, which are incorporated herein by reference, describe processes by which high speed tabular silver halide grains may be made with a narrow grain size distribution.

After the tabular grains are made as described in the aforesaid Nottorf and Ellis references, they are usually dispersed with larger amounts of binder (e.g., gelatin or other well-known binders such as polyvinyl alcohol, phthalated gelatins, etc.). In place of gelatin other natural or synthetic water-permeable organic colloid binding agents can be used as a total or partial replacement thereof. Such agents include water permeable or water-soluble polyvinyl alcohol and its derivatives, e.g., partially hydrolyzed polyvinyl acetates, polyvinyl ethers, and acetals containing a large number of extralinear —CH—CHOH— groups; hydrolyzed interpolymers of vinyl acetate and unsaturated addition polymerizable compounds such as maleic anhydride, acrylic and methacrylic acid ethyl esters, and styrene. Suitable colloids of the last mentioned type are disclosed in U.S. Pat. Nos. 2,276,322, 2,276,323 and 2,347,811. The useful polyvinyl acetals include polyvinyl acetaldehyde acetal, polyvinyl butyraldehyde acetal and polyvinyl sodium o-sulfobenzaldehyde acetal. Other useful colloid binding agents include the poly-N-vinyllactams of Bolton U.S. Pat. No. 2,495,918, the hydrophilic copolymers of N-acrylamido alkyl betaines described in Shacklett U.S. Pat. No. 2,833,650 and hydrophilic cellulose ethers and esters. Phthalated gelatins may also be used as well as binder adjuvants useful for increasing covering power such as dextran or the modified, hydrolyzed gelatins of Rakoczy, U.S. Pat. No. 3,778,278. As mentioned, these tabular silver halide emulsions may be chemically sensitized with salts of gold and sulfur as well known to those reasonably skilled in the art. Sulfur sensitizers include those which contain labile sulfur, e.g., allyl isothiocyanate, allyl diethyl thiourea, phenyl isothiocyanate and sodium thiosulfate for example. The polyoxyalkylene ethers in Blake et al., U.S. Pat. No. 2,400,532, and the polyglycols disclosed in Blake et al., U.S. Pat. No. 2,423,549. Other non-optical sensitizers such as amines as taught by Staud et al., U.S. Pat. No. 1,925,508 and Chambers et al., U.S. Pat. No. 3,026,203, and metal salts as taught by Baldsiefen, U.S. Pat. No. 2,540,086 may also be used. Preferably, we add the J-aggregating spectral sensitizing dyes of this invention prior to the chemical sensitization step noted above, although these dyes may be added at any time during the emulsion manufacture and before coating on a support.

The emulsions can contain known antifoggants, e.g., 6-nitrobenzimidazole, benzotriazole, triazaindenes, etc., as well as the usual hardeners, i.e., chrome alum, formaldehyde, dimethylol urea, mucochloric acid, etc. Other emulsion adjuvants that may be added comprise matting agents, plasticizers, toners, optical brightening agents, surfactants, image color modifiers, non-halation dyes, and covering power adjuvants among others.

The film support for the emulsion layers used in the novel process may be any suitable transparent plastic. For example, the cellulosic supports, e.g., cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. Preferred films include those formed from the polyesterification product of a dicarboxylic acid and a dihydric alcohol made according to the teachings of Alles, U.S. Pat. No. 2,779,684 and the patents referred to in the specification thereof. Other suitable supports are the polyethylene terephthalate/isophthalates of British Patent 766,290 and Canadian Patent 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al., U.S. Pat. No. 3,052,543 may also be used. The above polyester films are particularly suitable because of their dimensional stability.

When polyethylene terephthalate is manufactured for use as a photographic support, the polymer is cast as a film, the mixed polymer subbing composition of Rawlins U.S. Pat. No. 3,567,452 is applied and the structure is then biaxially stretched, followed by application of a gelatin subbing layer. Upon completion of stretching and the application of subbing compositions, it is necessary to remove strain and tension in the base by a heat treatment comparable to the annealing of glass. Air temperatures of from 100° C. to 160° C. are typically used for this heat treatment, which is referred to as the post-stretch heat relax.

The emulsions may be coated on the supports mentioned above as a single layer or multi-layer element. For medical X-ray applications, for example, where silver coating weights are generally high, layers of emulsion are coated on both sides of the support which conventionally contains a dye to impart a blue tint thereto. Contiguous to the emulsion layers it is conventional, and preferable, to apply a thin stratum of hardened gelatin supra to said emulsion to provide protection thereto.

This invention will now be illustrated by the following examples.

EXAMPLE 1

A silver bromide tabular emulsion was made according to the teachings of Ellis, U.S. Pat. No. 4,801,522. After precipitation of the grains the average aspect ratio was determined to be about 5:1 and thickness of about 0.2 μm. These grains were dispersed in photographic grade gelatin (about 117 grams gelatin/mole of silver bromide) and a suspension of 200 mg of Dye A in 25 ml of methanol added to achieve 133 mg of dye per mole of silver halide.

Dye A

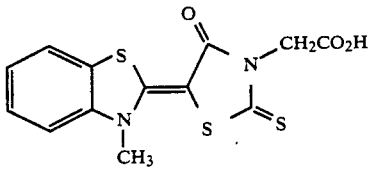

3-Carboxymethyl-5-(3-methyl-2-benzothiazolylidene)rhodanine

The emulsion then was brought to its optimum sensitivity with gold and sulfur salts as is well-known to those skilled in the art. The emulsion was stabilized by the addition of 4-hydroxy-6-methyl-1,3,3a,7-tetrazaindene and 1-phenyl-5-mercaptotetrazole. The usual wetting agents, antifoggants, coating aids and hardeners were added. Compound 1 was then added as a methanol solution. This emulsion was then coated on a dimensionally stable, 7 mil polyethylene terephthalate film support which had first been coated with a conventional resin sub followed by a thin substratum of hardened gelatin applied supra thereto. These subbing layers were present on both sides of the support. The emulsion was coated on one side at 2 g silver per square meter. A thin abrasion layer of hardened gelatin was applied over the emulsion layer. For control purposes, a similar emulsion was made without the compound of this invention. Samples of each of these coatings were given an exposure through a test target and a conventional step wedge to X-rays interacting with an X-ray intensifying screen and then developed in a conventional X-ray film processor. Evaluation of the samples are summarized as follows:

TABLE 1

| No. | Description | Amount (mg/mol AgBr) | Relative Contrast | Relative Covering Power |
|---|---|---|---|---|
| 1 | Control | 0.00 | 1.00 | 1.00 |
| 2 | Compound 1 | 100 | 1.26 | 1.08 |
| 3 | Compound 1 | 200 | 1.14 | 1.12 |

As shown above, the presence of compound 1 provides significant increase in both contrast and silver halide covering power.

EXAMPLE 2

An emulsion similar to that of Example 1 was prepared, except that Compound 1 was added to the silver halide emulsion prior to addition of the 4-hydroxy-6-methyl-1,3,3a,7-tetraazaindene. Evaluation of the samples gave the following results:

TABLE 2

| No. | Description | Amount (mg/mol AgBr) | Relative Contrast | Relative Covering Power |
|---|---|---|---|---|
| 1 | Control | 0.00 | 1.00 | 1.00 |
| 2 | Compound 1 | 50 | 1.13 | 1.09 |
| 3 | Compound 1 | 100 | 1.15 | 1.11 |

EXAMPLE 3

An emulsion similar to that of Example 1 was prepared, except that sensitizing dye B was used.

Dye B

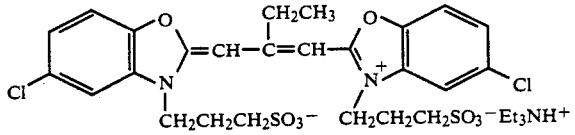

Anhydro-9-ethyl-5,5'-dichloro-3,3'-bis(3-sulfopropyl-)oxacarbocyanine hydroxide, triethylamine salt Evaluation of the samples gave the following results:

TABLE 3

| No. | Description | Amount (mg/mol AgBr) | Relative Contrast |
|---|---|---|---|
| 1 | Control | 0.0 | 1.00 |
| 2 | Compound 1 | 67 | 1.12 |
| 3 | Compound 5 | 17 | 1.18 |
| 4 | Compound 6 | 67 | 1.23 |
| 5 | Compound 6 | 100 | 1.18 |
| 6 | Compound 7 | 100 | 1.12 |

These examples clearly illustrate the contrast and covering power enhancement consistently obtained with these heterocyclic thiones on tabular grain emulsion.

Examples of specific heterocyclic thiones useful within the ambit of this invention include: Thiones 1,5,6 and 7 can be procured from commercial sources. Compound 4 is prepared by method of Halasa, et al., *J. Org. Chem.*, 36, 636 (1971):

5-Methoxy-2-mercaptobenzothiazole (18.3 g, 0.1 mol) was dispersed in 125 ml 95% ethanol. Addition of 10.1 g (0.1 mol) triethylamine gave a brown solution. Addition of iodomethane (14.2 g, 0.1 mol) was slightly exothermic. Additional heating brought the mixture to reflux for 2 hours. After cooling, the residue was dispersed in isopropanol and filtered to remove triethylammonium iodide. The filtrate was mixed with water and the layers separated. The aqueous phase was extracted 3×50 methylene chloride. The organic portions were combined, washed with brine, and dried with $Na_2SO_4$. Filtration and rotary evaporation yielded 21.85 g brown liquid which was distilled at 158°–162° C. (0.125 mm) to give 16.73 g (85%).

The thioether, 4.2 g, was heated with 0.2 g iodine at 182° C. for 4 hours. The produce was dissolved in dichloromethane, treated with Darco activated carbon, filtered, and evaporated. The residue was recrystallized from methanol to give 2.00 g, mp 144° C.

Compound 2 was prepared by reaction of 16.7 g 2-mercaptobenzothiazole and 9.43 g 40% aqueous formaldehyde in 150 ml acetone. After stirring overnight, the solvent was removed and the residue recrystallized from methanol to give 12.7 g, mp 120°–125° C.

Compound 3 was prepared by reaction of 8.34 g 2-mercaptobenzothiazole, 3.80 g 40% aqueous formaldehyde, and 3.26 g 70% aqueous ethylamine in 50 ml hot methanol. The mixture was stirred overnight, filtered, and the filtrate evaporated to give 4.18 g of an oil that ultimately crystallized, mp 169°–172° C.

What is claimed is:

1. In a tabular grain emulsion wherein at least 50% of said grains are tabular silver halide grains with a thickness of at least 0.1 μm, preferably with a thickness of about 0.2 μm, and an aspect ratio of greater than 2:1, dispersed in a binder, and wherein said tabular grain emulsion is a negative working radiographic element, the improvement comprising in said emulsion a covering power enhancing amount of a thione with the following structure:

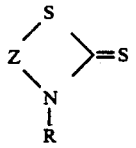

wherein Z represents sufficient carbon atoms to form a 5 membered or aromatic ring, or substituted 5 membered or aromatic ring, and R is an alkyl of 1–5 carbon atoms, a sulfoalkyl group of 2–5 carbon atoms, a dialkyl aminomethyl or a hydroxymethyl group.

2. The element of claim 1 wherein said thione is selected from the group consisting of:

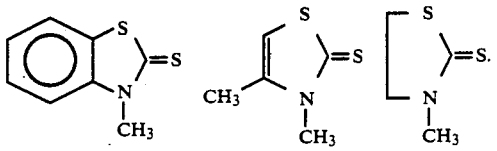

3. The element of claim 1 wherein said thione is present in the range of 10 to 500 mg per 1.5 moles of silver halide present in said emulsion.

4. The element of claim 3 wherein said thione is present in the range of 50 to 200 mg per 1.5 moles of silver halide.

5. The element of claim 1 wherein said tabular grains have an aspect ration of 2:1 and a thickness of 0.4 mu and said grains are predominantly silver bromide.

6. The element of claim 2 wherein said tabular grain emulsion is coated on both sides of a photographic support to form a radiographic element.

* * * * *